United States Patent [19]

Lykken et al.

[11] Patent Number: 5,062,316

[45] Date of Patent: Nov. 5, 1991

[54] HANDLE POSITION CONTROL APPARATUS

[75] Inventors: Thomas G. Lykken; Philip T. Kemper, both of Fargo, N. Dak.

[73] Assignee: J. I. Case Company, Racine, Wis.

[21] Appl. No.: 423,843

[22] Filed: Oct. 19, 1989

[51] Int. Cl.[5] ..... G05G 5/06

[52] U.S. Cl. ..... 74/529; 74/527

[58] Field of Search ..... 74/97, 529, 527, 491, 74/534, 526, 475

[56] References Cited

U.S. PATENT DOCUMENTS

| | | | |
|---|---|---|---|
| 2,586,075 | 2/1952 | Miller | 74/97 R |
| 2,943,710 | 7/1960 | Lindmark | 74/97 R |
| 3,184,989 | 5/1965 | Rhodes | 74/97 R |
| 3,316,776 | 5/1967 | Schröter | 74/97 R |
| 3,768,321 | 10/1973 | Cox | 74/97 R X |
| 3,906,816 | 9/1975 | Nepote | 74/97 R X |
| 4,203,291 | 5/1980 | Youngers | 74/471 R X |
| 4,219,069 | 8/1980 | Stockman | 74/97 R X |
| 4,358,965 | 11/1982 | Schroeder | 74/475 |
| 4,471,564 | 9/1984 | Beny | 74/526 X |
| 4,566,667 | 1/1986 | Yanagisawa | 74/534 X |

*Primary Examiner*—Vinh T. Luong

*Attorney, Agent, or Firm*—Jansson & Shupe, Ltd.

[57] ABSTRACT

An apparatus for controlling the position of an operating handle includes a plate which couples such operating handle to a device such as a hydraulic valve. The plate includes a detent notch, a shoulder and a control surface. An auxiliary lever is mounted for pivoting movement between a first, engaged position and a second, disengaged position and is maintained in either position by a compression spring. Such compression spring exhibits toggling movement as the lever is moved between positions. The lever includes a pin for engaging the detent notch when the lever is in the first position and the handle is thereby retained in a predetermined position. When the pin is in contact with the control surface and with the shoulder, the handle is retained in an operating position. Movement of a stop mechanism to a position which does not obstruct handle movement also permits the operating handle to move to a "float" position.

2 Claims, 4 Drawing Sheets

HANDLE POSITION CONTROL APPARATUS

BACKGROUND OF THE INVENTION

1. Field of the Invention

This invention is related generally to an apparatus for controlling the position of movable handles and, more particularly, to such an apparatus used for controlling the position of implement operating handles used on hydraulically operated machinery such as large agricultural tractors and the like.

2. Description of the Prior Art

Multi-function machines often have a plurality of handles used by the operator to control the speed and direction of individual functions. An example of such a machine is an agricultural tractor used to tow and power implements. Often, these implements have one or several functions which are positioned or powered by hydraulic cylinders or by hydraulic rotary motors. An example of one such type of implement is a crop sprayer while another example is a slitter type planter for planting grain crops.

A planter machine of this type may employ several large bins for holding the seed prior to planting and a motorized auger for evenly distributing the seed to the planting heads. It may also include a motorized air compressor used to urge the seed through distribution conduits. In addition, larger planter machines of this type will often be constructed to have a central section upon which the wheels are mounted and a pair of side or wing sections used for row marking. Since such a machine is much too wide for towing on public highways when the wings are extended, it will be constructed with foldable wings. Other examples of multi-function implements include grain crop harvesting machines such as towed combines, as well as vegetable harvesting machines.

Towed implements such as the foregoing share several common characteristics. They include functions positioned by hydraulic cylinders as well as those driven by hydraulic motors, the latter often driving devices having very significant inertia. In addition, such implements need to be capable of being quickly configured for transporting, for working at their intended function or for being towed during transport or for other purposes.

These requirements place unusual demands upon the hydraulic control system of the towing tractor and, particularly, upon the ways in which the hydraulic valve control handles are positioned. The operator must be able to accurately position several handles within a short period of time while yet avoiding inadvertent movement of any of them in a way which could cause breakage of the implement or of a hydraulic component.

For example, the operator may wish to position an implement side wing to a folded position for transporting and then immediately, securely lock the wing in that position. The operator may also wish to permit a high inertia motorized function to "coast" or "float" to stop rather than stopping the function by moving the control handle quickly from an operating position to a neutral or "off" position. Rapid movement to the neutral position may cause the hydraulic valve to block the passage of oil into or out of the motor. The result may be extremely high pressure "spikes". This known problem often dictates the use of hydraulic bypass relief valves or deceleration valves to prevent physical damage to the hydraulic hoses, to the hydraulic motor or to the mechanism being driven thereby.

A float position may also be required if it is desired that the towed implement freely follow the contour of the earth rather than being in working engagement therewith. Yet another reason to use a float position is to permit an implement to rapidly descend from a raised, transport position to a working position as predetermined by mechanical stops. Moving the related hydraulic valve to the float position connects together the two operating ports of a hydraulic cylinder or the hydraulic motor so that unimpeded movement to the working position may quickly occur.

Still another demand imposed by modern implements and the tractors which tow them is that once an implement is set in an operating position, with certain functions set at operating speed, the levers controlling these functions need to be positionally retained. This frees the operator's hands for other tasks. Even with the use of detents in hydraulic valves, the forces imposed upon the valve spool at elevated operating pressures will often urge the spool out of detent to neutral. The least troublesome event which flows from this happenstance is that the operator will have to reposition the valve to the operating position and may be forced to make another pass over the affected portion of the field.

In summary, the demands of today's hydraulically powered, multi-function implements have created demands for a handle position control apparatus which will provide neutral lock out, float control, and retention of a lever in an operating position.

One approach to the control of an operating handle position is shown in U.S. Pat. No. 4,358,965. The locking mechanism described therein addresses the fact that it is often desirable to lock an operating handle in the neutral position. The mechanism does so by swinging a separately movable latching bar into a pivotable camming detent connected to the handle. No provision is made for retaining the handle in an operating position, for permitting a hydraulically powered function to "float" or for controllably decelerating a high inertia load.

Still another approach to the problem of maintaining an operating handle in a position is shown in U.S. Pat. No. 4,203,291. In the depicted apparatus, the main operating handle is depressed to disengage a pair of pins from any one of several sets of apertures which are arranged along the operating quadrant. The handle may be maintained at a position adjacent any set of apertures by engaging the pins with that set. A separate release lever is required to be operated to move the main operating handle from a neutral to an operating position. In addition to recognizing the need for a neutral lock function, this apparatus also recognizes the requirement to maintain the operating handle in any one of several operating positions, thereby freeing the operator's hands for other tasks. Notwithstanding, this control mechanism includes no feature whereby a "float" function may be obtained.

Having failed to recognize these needs, the earlier handle position control mechanisms have failed to provide a solution.

A handle position control apparatus which provides a float position, a neutral lockout function and the ability to retain the handle in an operating position would be an important advance in the art.

OBJECTS OF THE INVENTION

It is an object of this invention to overcome some of the problems and shortcomings of the prior art.

Another object of this invention is to provide a handle position control apparatus capable of permitting the controlled deceleration of inertia loads.

Still another object of this invention is to provide a handle position control apparatus which permits floating control of a hydraulic function.

Still another object of the invention is to provide a handle position control apparatus which incorporates a neutral lock capability.

Yet another object of the invention is to provide a handle position control apparatus useful for maintaining a handle in an operating position in opposition to forces which may result from elevated hydraulic pressures.

Another object of the invention is to provide a handle position control apparatus which may be used upon tractors for controlling towed implements.

These and other important objects will be apparent from the descriptions of this invention which follow.

SUMMARY OF THE INVENTION

In general, an apparatus for controlling the position of an operating handle includes a plate for coupling an operating handle to a device to be positioned. The plate includes a detent notch. An auxiliary lever is movable between a first, engaged position and a second, disengaged position. The lever includes means for engaging the detent notch when the lever is in the first position and the handle is thereby retained in a predetermined position. A force member is coupled to the lever and acts thereon to maintain the lever in either the engaged position or the disengaged position.

More particularly, the plate is mounted for pivoting motion and has an operating handle extending upwardly therefrom. The plate includes an arm which extends outward from the pivot axis and which may have a cable pivotably attached thereto. Movement of the handle through an arc will cause reciprocating, generally linear movement of the cable. The plate may thereby be connected to a hydraulic valve, the position of which is to be controlled by movement of the operating handle. A detent notch is formed in the plate and in a highly preferred embodiment, the plate will also include a control surface.

An auxiliary lever is mounted for pivoting movement about a pivot axis spaced slightly from the pivot axis of the plate. The auxiliary lever is movable between an engaged position and a disengaged position. The lever is equipped with engaging means such as a pin so that when the lever in the engaged position, the pin may engage the detent notch or the control surface.

A force member such as a compression spring is coupled between the lever and a stationary point. It is constructed and arranged to provide a toggling action as the lever is manually moved between the two positions. When so arranged, the spring will retain the lever in the position selected. When the auxiliary lever is in the disengaged position, it is entirely separated from contact with the plate and the operating handle may be freely moved through its entire quadrant of movement.

When the auxiliary lever is in the engaged position and when the operating handle is in neutral, the pin will engage the detent notch. This prevents the handle from being moved unless the auxiliary lever is intentionally disengaged.

Immediately adjacent the detent notch is the control surface which defines a curved or arcuate profile terminating in a shoulder. If the handle is advanced in the forward or "raise" direction to the operating position and if the auxiliary lever is in the engaged position, the pin will bear against that portion of the control surface which is immediately adjacent the shoulder. Because of the interference between the pin and the shoulder, it will then be impossible to return the handle to the neutral position unless the auxiliary lever is disengaged.

In a highly preferred embodiment the operating handle and its associated hydraulic valve will be constructed and arranged to provide a "float" capability. In a preferred arrangement, this capability will be available when the handle is urged to its extreme forward position of travel beyond the operating position. The hydraulic valve will be constructed so that when in the float position, it connects together the two operating ports of a hydraulic cylinder or a hydraulic motor. In this way, the apparatus connected to the cylinder or to the motor may freely move at the urging of external forces. This float position also permits high inertia loads to decelerate gradually rather than abruptly as may otherwise result if the operating handle was brought directly to the neutral position. However, a preferred apparatus will be arranged so that inadvertent movement of the operating handle into the float position will be avoided.

While the stop plate mechanism described below is known per se, its incorporation with the inventive apparatus provides a unique combination. This mechanism will help prevent movement of the operating handle into the float position unless that position is intentionally selected by the operator.

In a highly preferred embodiment, the stop plate mechanism will be incorporated as part of the console in which the operating handles are mounted. The plate actuating button is arranged to protrude upward through a quadrant slot formed in the console surface. The stop plate mechanism is arranged to selectively block handle travel or permit its access to the extreme forward segment of the slot.

Preferably, the stop plate is mounted beneath and adjacent the console surface and is slidably movable between an access location and a blocking location. In the access location, the operating handle may be moved to the extreme forward position of travel, i.e., to the float position. When the stop plate is in the blocking location, the operating handle may be moved to the maximum operating position but is prevented from further forward movement into the float position.

To use the inventive apparatus, it is first assumed that an operating handle is in the neutral or "off" position and that the pin of its auxiliary lever is engaged with the detent notch. To operate a hydraulic function, the auxiliary lever is moved slightly rearward to disengage the pin from the notch and permit the lever to be moved in the forward direction. The lever is then released so that when the handle reaches the operating position, the pin can engage the shoulder and retain the handle in that position.

Further assuming that this function involves a high inertia load which the operator wishes to decelerate to a stopped condition, the stop plate is moved to its access location and the operating handle is moved farther forward to the float position. The load then decelerates and stops. If the operator then wishes to resume operation of this function, the operating handle is moved rearward until the pin again engages the shoulder. The stop plate is then moved to its blocking location so that the handle cannot then be inadvertently moved back into the float position. As used herein and unless otherwise indicated, the directional expressions "forward", "rearward", "up", "down" or terms of similar meaning refer to those directions as seen and viewed by an operator using the operating handles and the inventive apparatus.

DETAILED DESCRIPTIONS OF PREFERRED EMBODIMENTS

The figures depict an apparatus 10 for controlling the position of an operating handle.

Figure 1:
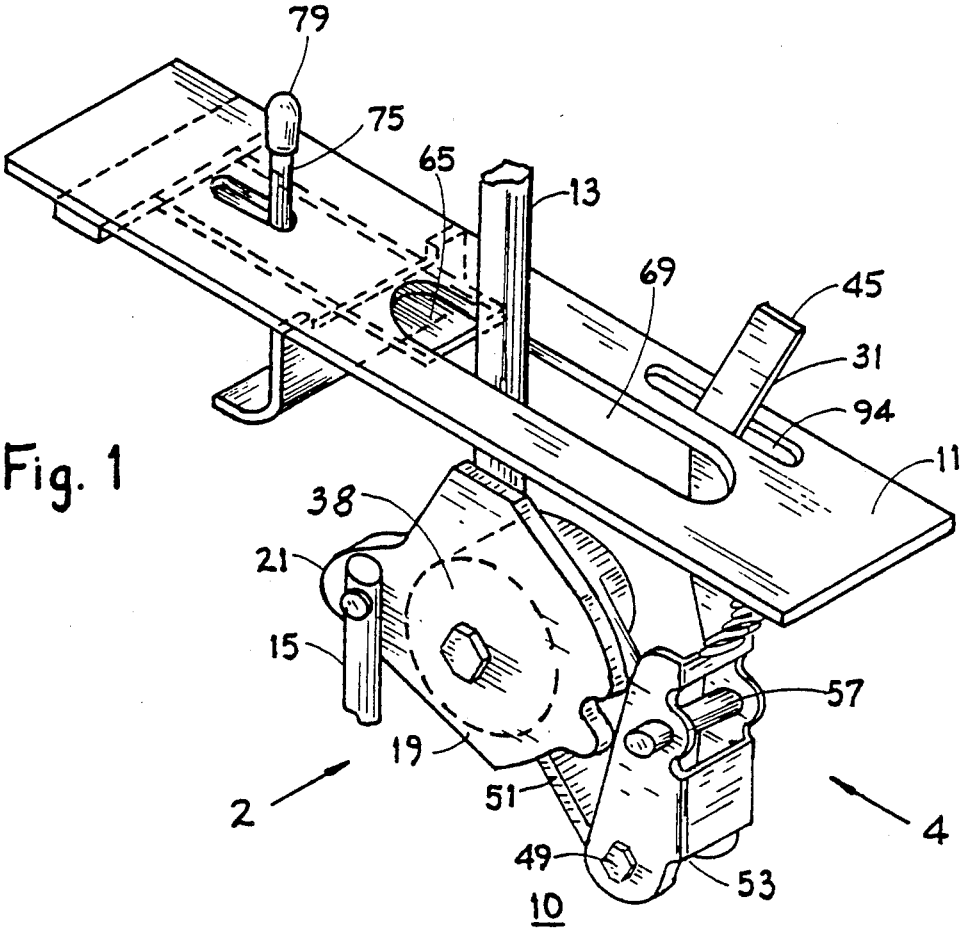
FIG. 1 is a perspective view of the handle position control apparatus mounted in an operating console, with parts shown in dotted outline.
Figure 2:
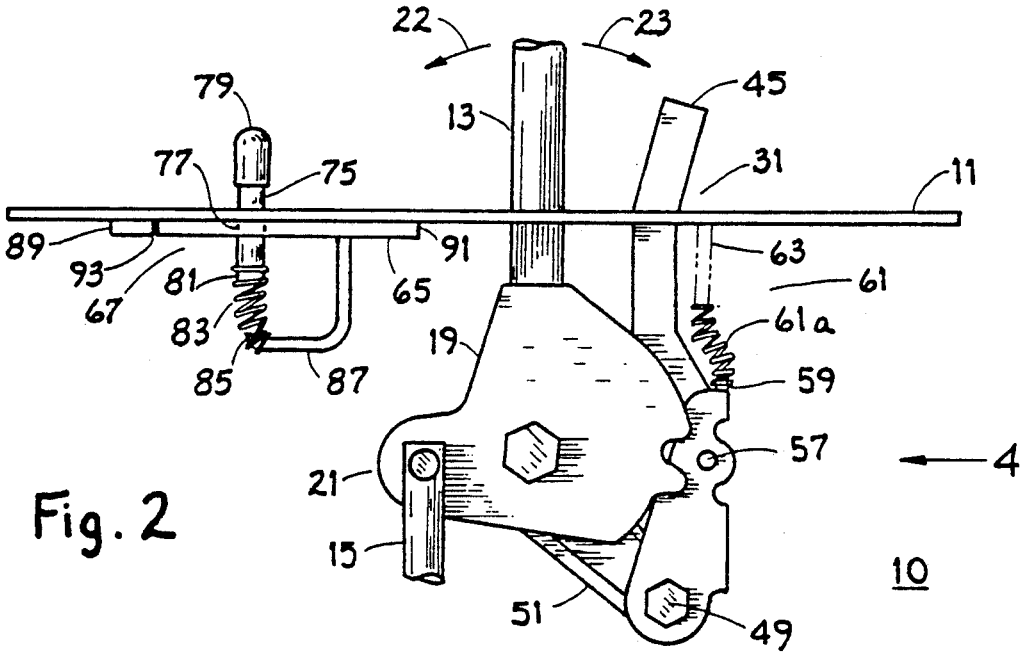
FIG. 2 a side elevation view of the apparatus of FIG. 1 taken along the viewing axis 2 thereof and with the auxiliary lever in the disengaged position.

Referring first to FIGS. 1 and 2, the apparatus 10 is shown in conjunction with an operating station or console 11 such as might be found in a large agricultural tractor. While only a single operating handle 13 is shown the operating console 11 may include a plurality of ganged operating handles 13, each of which is linked by a flexible cable 15 to a hydraulic valve (not shown) to be positioned. Pivoting movement of an operating handle 13 about the mounting axis 17 will produce linear movement of the cable 15. At least with agricultural tractors, the Society of Automotive Engineers (SAE) has formulated certain conventions for the arrangement of operating handles such as those depicted. Particularly, movement of an operating handle 13 toward the front of the tractor (away from the operator) will initiate a function in the "raise" direction with respect to a device—a plow, marker wing or the like—positioned by a hydraulic cylinder. For a device powered by a hydraulic motor, an exemplary blower or pump, movement of the operating handle 13 in the same direction will energize the hydraulic motor in the forward or working direction.

Figure 3:
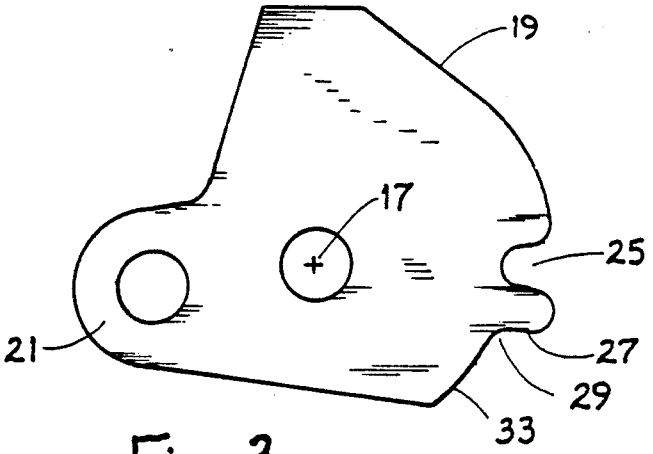
FIG. 3 a side elevation view of the plate which is shown in FIG. 2.
Figure 5:
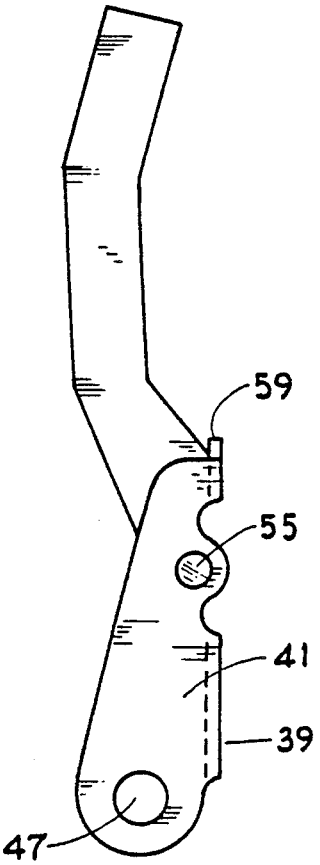
FIG. 5 is a side elevation view of the auxiliary lever of FIG. 4 taken along the viewing axis 5 thereof and with parts shown in dotted outline.
Figure 4:
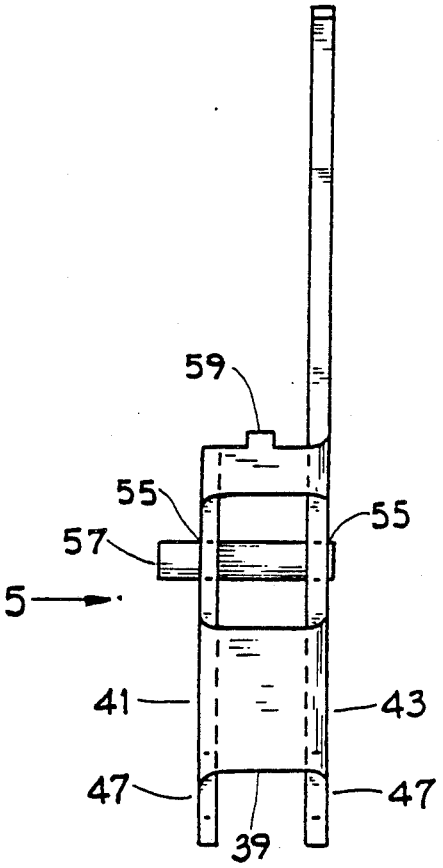
FIG. 4 is a rear elevation view of the auxiliary lever shown in FIG. 1 and 2 taken along the viewing axis 4 thereof and with parts shown in dotted outline.

Referring next to FIGS. 1-3, the apparatus 10 includes a plate 19 for coupling an operating handle 13 to a hydraulic valve to be positioned. The plate 19 is mounted for pivoting movement about a first axis 17 and has an operating handle 13 rigidly attached thereto. The plate 19 also includes a projecting ar 21 to which the end of the cable 15 is pivotably pinned. The operating handle 13, the plate 19 and the arm 21 thereby define a bell crank whereby movement in the forward or raise direction as shown by the arrow 22 will result in downward, substantially linear movement of the cable 15. Rearward movement of the handle 13, as shown by the arrow 23, will result in upward movement of the cable 15 and the hydraulic valve connected to the cable 15 may thereby be positioned by such movement. While plate 19 and handle 13 are shown as joined components, they may be fabricated as a single handle assembly.

Referring particularly to FIG. 3, the plate 19 also includes a detent notch 25, a shoulder 27 and a control surface 29 immediately adjacent the shoulder 27. As will be described in detail following, it is the interaction of the auxiliary lever 31 with the detent notch 25 and shoulder 27 which provides handle position control. The apparatus 10 is configured so that this interaction occurs only in the "raise" or "forward" direction of handle movement (as well as in neutral) and then only if the auxiliary lever 31 is in the engaged position. In the "lower" or "reverse" direction and for the depicted arrangement, it has no effect on handle position. However, it will be apparent that the principles of the invention could be used to control handle position in the reverse direction, if so desired.

Figure 10:
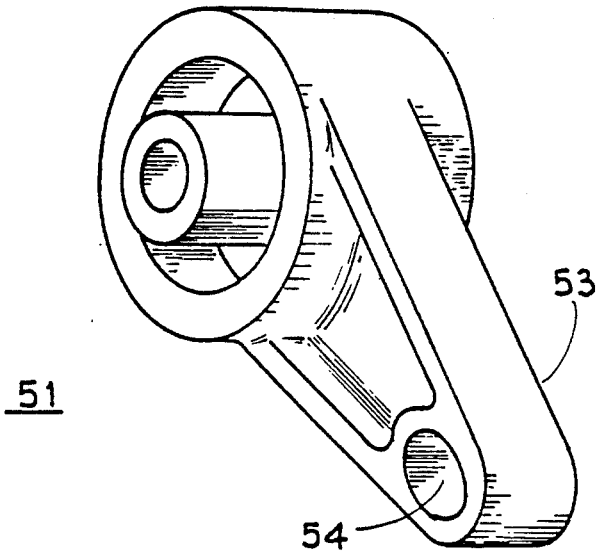
FIG. 10 is a perspective view of a bushing component of the invention.

Referring next to FIGS. 1, 2, 4 and 5, a highly preferred auxiliary lever 31 is shown to include a back web 39 and a pair of side webs 41, 43. The side web 43 extends upwardly to define the lever handle 45 to be grasped by the operator. A lower aperture 47 is formed in each of the side webs 41, 43 to be in registry with one another, thereby permitting the lever 31 to be mounted for pivoting movement about a second axis 49. Referring additionally to FIG. 10, mounting is on a bushing 51 having a nose 53 of reduced width. If the hole 54 is made slightly elliptical as shown, it will facilitate the easy insertion of a through-bolt (not shown) on multiple handle installations. Such a through-bolt will prevent the movement of an operating handle 13 from causing inadvertent rotational movement of the adjacent bushing 51 and resultant rotation of the adjacent handle 13. Preferred mounting is by cooperatively selecting the interior spacing of the side webs 41, 43 and the thickness of the bushing nose 53 so that the lever 31 may pivot on the nose 53 with slight clearance.

The lever 31 also includes an upper aperture 55 formed in each of the side webs 41, 43 to be in registry with one another. These apertures 55 are sized to receive a hardened roll pin 57 with snug fit. The length of the roll pin 57 is preferably selected so that when one end thereof is essentially flush with the side web 43, the pin protrudes beyond the web 41 to a distance sufficient to fully engage the plate 19. As described in greater detail following, it is this roll pin 57 which coacts with the plate 19 to control handle position.

At the upper extremity of the back web 39 and positioned generally midway between the side webs 41, 43, an upwardly projecting nubbin 59 is formed to retain one end of a force member 61 such as a compression spring 61*a*. The other end of the compression spring 61*a* is retained by a downwardly projecting stationary finger 63 formed on the underside of the operating console 11 or embodied in a plate mounted on the underside of the console.

As best seen in FIG. 2, the relative location of the finger 63 and the nubbin 59 and the relative spacing therebetween should be selected such that when the lever 31 is in its disengaged position, the spring has "toggled" to the right and assumes a partially relaxed position as shown in FIG. 2. The result will be a force vector which tends to urge the auxiliary lever 31 to the right as viewed in FIG. 2 and to maintain it in the disengaged position. When in the disengaged position, the lever 31 is inoperative for controlling the position of the operating handle 13 and the handle 13 is thereby permitted to be generally, freely moved between its extremes of travel. In the raise direction, the ability to move the operating handle 13 to the forward extreme of travel into the float position is dependent upon the position of a stop plate 65 as further described below.

Figure 6:
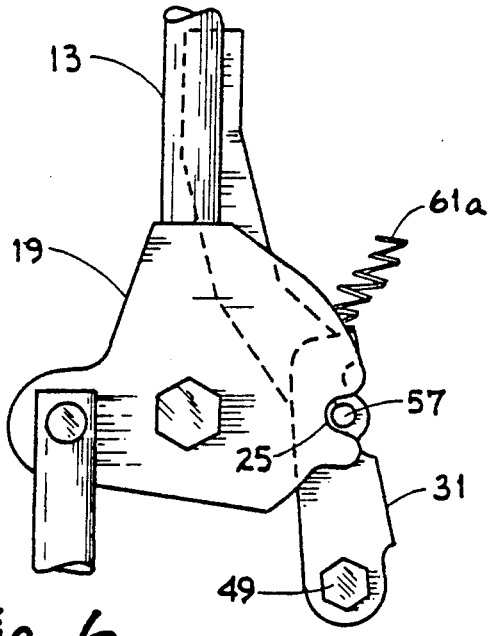
FIG. 6 is a side elevation view of a portion of the apparatus shown in FIG. 2, with the auxiliary lever in the engaged position and the operating handle in neutral.
Figure 7:
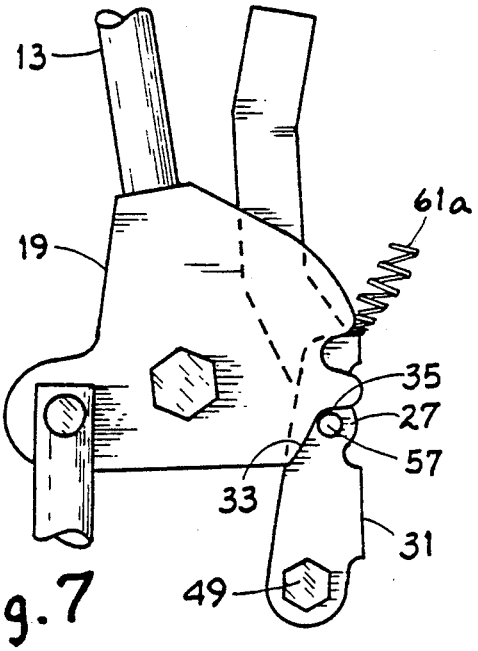
FIG. 7 is a side elevation view of a portion of the apparatus shown in FIG. 2, with the auxiliary lever in the engaged position and the operating handle in the maximum operating position.
Figure 8:
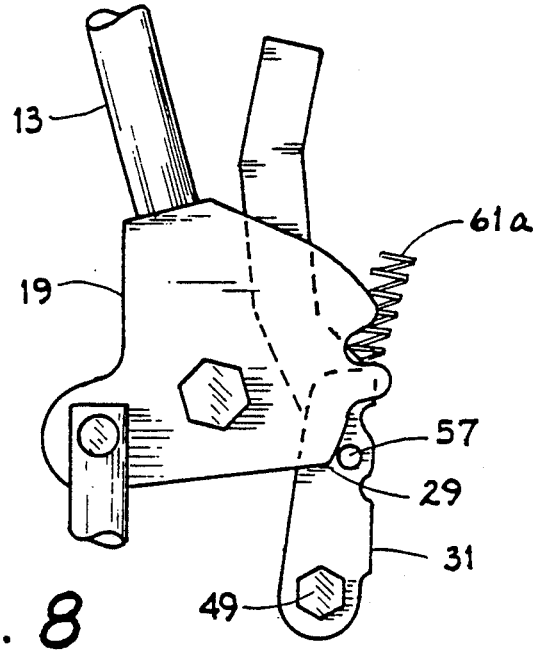
FIG. 8 is a side elevation view of a portion of the apparatus shown in FIG. 2, with the auxiliary lever in the engaged position and the operating handle in the float position.

Referring next to FIGS. 6–8, the lever 31 is shown in the engaged position and is maintained there by the spring 61*a*. That is, when the spring 61*a* is toggled from right to left, it passes from a partially relaxed state to a more fully compressed state and thence again to a partially relaxed state. When in the left position shown, it exerts a force vector upon the lever 31 which urges it to the left as seen in FIGS. 6–8 and when the lever 31 is in that position, the roll pin 57 will be in engagement with the plate 19. From the foregoing, it will also be appreciated that the toggle action of the spring 61*a* will maintain the lever 31 in either the disengaged position or the engaged position, as selected by the operator. It is apparent from the foregoing and from the drawing that the force member 61 acts solely on the lever 31 and is incapable of exerting pivoting torque on the operating handle 13.

Referring particularly to FIG. 6, the operating handle 13 and plate 19 are shown in the neutral position at which the pin 57 engages the detent notch 25. When so positioned, the lever 31 will prevent the operating handle 13 from being inadvertently moved out of the neutral position.

Referring to FIGS. 7, 8 and particularly to FIG. 7 it is assumed that the operator has moved the lever 31 sufficiently far to the right to permit the pin 57 to become disengaged from the detent notch 25. It is also assumed that the operator has urged the operating handle 13 to position the hydraulic valve at its maximum operating position. Hydraulic valves used on machinery such as large agricultural tractors are often constructed to have an internal detent at the maximum operating position. With such a detent, the valve may be retained in that position without the continuous application of force to the operating handle 13.

However, if the hydraulic system is operating near its maximum pressure and flow rate, the valve internal forces may cause the valve spool to be urged out of detent and into the neutral position. To help prevent this undesirable event, the pin 57 is engaged with that portion of control surface 29 which is immediately adjacent shoulder 27. This engagement retains the operating handle 13 and its associated valve in the maximum operating position, notwithstanding the aforementioned forces.

Referring next to FIGS. 1, 2, 8 and 9 it is sometimes desirable to permit towed agricultural implements to "float" to a position, i.e., to be free to move by means other than under the control of the machine operator. It may also be desirable to permit a high inertia load to coact to a stop to help avoid damage to the load, its drive train or the hydraulic system. Reasons therefor are described above.

To provide "float" operation, preferred hydraulic valves will include a separate valve spool position for the purpose. This position is often located beyond the maximum operating position which is shown in FIG. 7. Notwithstanding the desirability of incorporating a "float" position, it is preferred to include means such as a stop plate 65 and stop plate mechanism 67 which will prevent movement of a handle to that position except by intentional selection of the operator.

Figure 9:
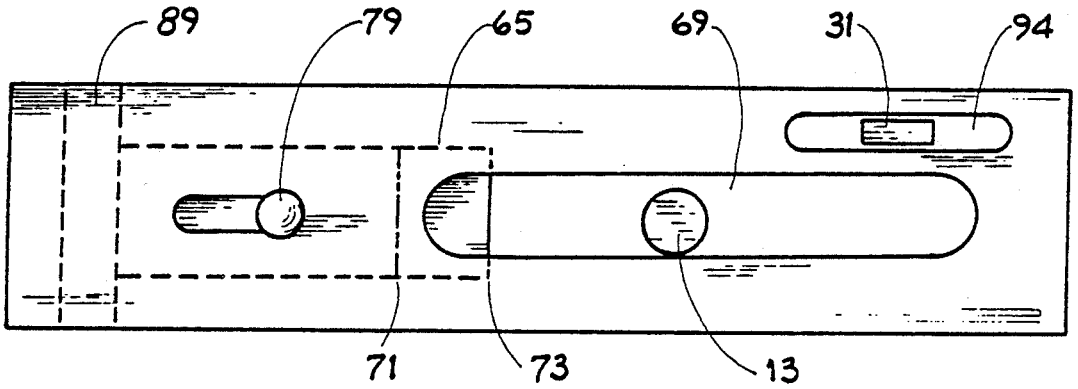
FIG. 9 is a top plan view of the apparatus shown in FIGS. 1 and 2 with parts shown in dotted outline and other parts removed for clarity.

Referring particularly to FIGS. 1, 2 and 9, a preferred stop plate mechanism 67 will be mounted on the under side of the console 11 adjacent the quadrant slot 69 in which the handle 13 moves and forward of slot 94 in which lever 31 moves. The mechanism 67 includes a flat stop plate 65 movable between an access position 71 and a blocking position 73, both as shown in dotted outline in FIG. 10. The plate 65 is generally rectangular in perimeter shape. It has a shaft 75 received in a hole 77 formed in the plate 65 and extending vertically upward and downward therefrom. The shaft 75 is sized to provide an interference fit with the hole 77 so as to be rigidly, permanently attached to the plate 65. The shaft 75 thereby defines an actuating button 79 for moving the stop plate 65 and a projection 81 for retaining one end of a coiled compression spring 83.

The other end of the spring 83 is retained on a projection 85 which extends angularly upward from a generally L-shaped bracket 87 mounted at the under surface of the console 11. A barrier 89 is placed at that end of the plate 65 which is spaced from the slot 69 and is arranged laterally across the path of movement of the plate 65. In the blocking position as shown in FIGS. 1 and 2, the first end 91 of the plate 65 extends rearward toward the operator to mask a portion of the slot 69 and the second end 93 abuts the barrier 89. This prevents movement of the operating handle 13 in the slot 69 to the extreme forward or float position. It is to be understood that when the plate 65 is in the blocking position 73, the compression spring 83 is toggled to the right to urge the plate 65 into sliding contact with the under surface of the console 11.

Access to the float position may be by first depressing the button 79 to disengage the second end 93 of the plate 65 from the barrier 89. The depressed button 79 is then urged forward (left as seen in FIG. 2) to permit the end 93 to slide beneath the barrier 89 and to be in overlapping engagement therewith. It is also to be appreciated that in this access position 71, the compression spring 83 has toggled to the left as shown in FIG. 2, thereby continuing to maintain the plate 65 in the access position 71.

If the machine operator wishes to permit an implement to float or to permit a high inertia load to coast to a stop, the stop plate 65 is moved to its access position 71 and the operating handle 13 is moved farther forward to the float position. When in the float position (and assuming lever 31 is in the engaged position), the pin 57 will be in contact with a portion 33 of the control surface 29 as shown in FIGS. 3 and 8. If the operator then wishes to resume normal operation of this function, the operating handle 13 is moved rearward until the pin 57 again engage that portion of the control surface 29 adjacent the shoulder 27. The stop plate 65 is then returned to its blocking position 73 so that the handle 13 cannot then be inadvertently moved back into the float position.

While the principles of this invention have been described in connection with specific embodiments, it should be understood clearly that these descriptions are made only by way of example and are not intended to limit the scope of the invention.

We claim:

1. A handle position control apparatus including:

an operating handle assembly having a plate for coupling such assembly to a hydraulic valve to be positioned, such plate including a detent notch, a shoulder and a control surface, the handle being mounted for movement from a neutral position through an operating position to a float position;

an auxiliary lever mounted for movement between a first, engaged position and a second disengaged position, such lever including an engagement pin for engaging such shoulder when in the first position, thereby preventing such handle from moving to such neutral position while yet permitting movement of the handle to the float position, such auxiliary lever further including a back web and a plurality of side webs attached to the back web, each of such side webs including an aperture for receiving a shaft on which such lever is pivotably moved, each of the side webs further including a hole for receiving such engagement pin, such pin engaging the detent notch, the shoulder or the control surface when such auxiliary lever is in the engaged position;

a force member embodied as a toggling-type compression spring coupled to such lever and acting thereon to maintain such lever in the first position or the second position; and, a stop plate mounted for movement between an access position for permitting such operating handle to be moved to the float position and a blocking location for preventing such operating handle from being moved to the float position;

such engagement pin preventing such operating handle from moving from the detent position when such engagement pin is in such detent notch.

2. The apparatus of claim 1 wherein such compression spring is captured between such back web and a stationary finger and wherein the compression spring is partially relaxed when the lever is in the engaged position or the disengaged position, becomes more fully compressed as the lever is moved from the engaged position toward the disengaged position and toggles to again become partially relaxed when the lever approaches the disengaged position.

* * * * *